US006641640B1

(12) United States Patent
Hesse et al.

(10) Patent No.: US 6,641,640 B1
(45) Date of Patent: Nov. 4, 2003

(54) HARD MATERIAL SINTERED COMPACT WITH A NICKEL- AND COBALT-FREE, NITROGENOUS STEEL AS BINDER OF THE HARD PHASE

(75) Inventors: Werner Hesse, Obrigheim (DE); Hans Wohlfromm, Mannheim (DE); Peter Uggowitzer, Ottenbach (CH); Markus Speidel, Birmenstorf (CH)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/857,032

(22) PCT Filed: Nov. 25, 1999

(86) PCT No.: PCT/EP99/09136

§ 371 (c)(1),
(2), (4) Date: May 31, 2001

(87) PCT Pub. No.: WO00/32828

PCT Pub. Date: Jun. 8, 2000

(30) Foreign Application Priority Data

Dec. 1, 1998 (DE) ..... 198 55 422

(51) Int. Cl.[7] ..... C22C 1/05

(52) U.S. Cl. ..... 75/236; 75/252; 419/26; 419/37; 419/38

(58) Field of Search ..... 75/236, 252; 419/37, 419/26, 38

(56) References Cited

U.S. PATENT DOCUMENTS

| | | | | |
|---|---|---|---|---|
| 3,368,882 A | | 2/1968 | Ellis | |
| 3,861,907 A | * | 1/1975 | Dulis et al. | |
| 3,936,297 A | * | 2/1976 | Harltine, III | |
| 3,964,878 A | | 6/1976 | Scheithauer | |
| 3,967,935 A | * | 7/1976 | Frehn | |
| 4,276,096 A | | 6/1981 | Kolaska | 148/166 |
| 4,308,059 A | | 12/1981 | Rymas | 75/240 |
| 4,608,318 A | * | 8/1986 | Makrides et al. | 428/553 |
| 4,946,644 A | * | 8/1990 | Schumacher et al. | 420/56 |
| 5,145,900 A | | 9/1992 | Sterzel | 524/404 |
| 5,198,489 A | | 3/1993 | Sterzel | 524/439 |
| 5,304,310 A | | 4/1994 | Lang | 210/639 |
| 5,362,791 A | | 11/1994 | Ebenhoech | 524/440 |
| 5,403,374 A | * | 4/1995 | Kitagawa et al. | 75/238 |
| 5,403,628 A | | 4/1995 | Konig et al. | 427/569 |
| 5,714,115 A | | 2/1998 | Speidel | 420/65 |
| 5,848,350 A | * | 12/1998 | Bulger | 419/36 |
| 5,860,055 A | | 1/1999 | Hesse | 419/36 |

FOREIGN PATENT DOCUMENTS

| | | |
|---|---|---|
| EP | 046 209 | 2/1982 |
| EP | 169 292 | 1/1986 |
| EP | 365 506 | 4/1990 |
| EP | 443 048 | 8/1991 |
| FR | 1 475 069 | 3/1967 |
| FR | 2 058 845 | 5/1971 |

OTHER PUBLICATIONS

Derwent Abst. J5 8031–059.
Abst. J. 8018–109.
Metal Injection Moulding of Nickel–Free Austenitc Stainless Steesl, Baehre et al., 1997.
Powder Injection Moulding, 1997,Wohlfromm et al. Novel Materials in Metal Injection Moulding 54–61.

* cited by examiner

*Primary Examiner*—Ngoclan Mai
(74) *Attorney, Agent, or Firm*—Keil & Weinkauf

(57) ABSTRACT

Hard sintered moldings having a nickel- and cobalt-free, nitrogen-containing steel as a binder of the hard phase, processes for the powder metallurgical production of these hard sintered moldings, in particular by powder injection molding, and powder injection molding materials for the production of these hard sintered moldings by powder injection molding.

5 Claims, No Drawings

HARD MATERIAL SINTERED COMPACT WITH A NICKEL- AND COBALT-FREE, NITROGENOUS STEEL AS BINDER OF THE HARD PHASE

The present invention relates to hard sintered moldings and feedstocks and processes for their preparation.

For the purposes of this invention, hard sintered moldings are defined as sintered materials which consist of a hard phase and a metallic phase as a binder of the hard phase. Hard sintered moldings, feedstocks and processes for their preparation are well known. Hard sintered moldings are generally very hard and have a high melting point but are also resistant to thermal shocks and therefore constitute a valuable group of materials. They are processed, for example, to combustion chamber linings or nozzle linings, cutting, drilling, milling, grinding, breaking, digging or press tools, sealing rings or bearing rings, welding electrodes, thread guides or the like. Among the known hard sintered moldings, particularly desirable materials are those whose hard fraction consists of hard ceramic materials, for example oxides, nitrides or carbides. Most frequently used hard materials are tantalum carbide and tungsten carbide. The metallic binder to be chosen is a metal which can be readily processed to give the hard sintered molding, does not impair the required properties of the material and binds the hard phase in a suitable manner. By far the most frequently used metals industrially are nickel and cobalt, but occasionally other metals which fulfill the required properties are also used. For example, JP-A 63-317 601 discloses the use of a cobalt-nickel alloy as a metallic binder. U.S. Pat. No. 3,964,878 describes hard sintered moldings with metal carbides whose metallic binder consists of the metal also contained in the carbide and additionally from 0.5 to 1.5% by weight of iron, copper or nickel. EP-A 169 292 and FR-A 1 475 069 describe hard sintered moldings having a metallic binder comprising iron, nickel and/or cobalt, the metallic binder of the hard sintered moldings disclosed in EP-A 365 506 additionally contains a special high-speed steel, and the metallic binder of the hard sintered moldings disclosed in JP-A 58-031 059 contains iron, nickel, cobalt and/or molybdenum. U.S. Pat. No. 4,308,059 describes a hard sintered molding bound by means of ruthenium. EP-A 46 209 discloses a hard sintered molding having steel as metallic binder. U.S. Pat. No. 3,368,882 discloses hard sintered moldings comprising 25–80% by volume of hard carbide such as WC or TaC and a binder matrix comprising a nitratable steel which is nitrated 45 on the surface of the sintered molding during preparation of the latter. FR-A-2 058 845 describes a hard sintered molding comprising 15–85% by volume of hard carbide which is dispersed in an austenitic steel matrix.

Hard sintered moldings additionally often have color properties which lead to an attractive external appearance of the workpieces produced therefrom and are therefore used not only as material for purely functional components but also as material in decorative applications, for example in watch cases, jewelry, writing implements or the like. An example of a known hard sintered molding is given, for example, in JP-A 48-018 109, which discloses hard sintered moldings consisting of TaC and a nickel-, molybdenum- and chromium-containing metallic binder and having a gold-like surface and their use in watch cases.

Usually, hard sintered moldings are produced by a powder metallurgical method. For this purpose, a mixture of the hard material powder and a metallic powder is introduced into a mold, generally compressed and then sintered, the metal powder and hard material powder combining to give the hard sintered molding. The sintered molding as such can then be further processed, for example aftertreated by a shaping procedure, or used, but it may also be milled and applied in the form of powdered hard sintered molding as surface layer on a workpiece. For example, DE-A 40 37 480 describes the production of a sintered body comprising tungsten carbide, titanium carbide, tantalum carbide or niobium carbide and cobalt as metallic binder.

A substantial disadvantage of simple powder metallurgical shaping processes, for example pressing in a mold, is that only moldings having a comparatively simple external shape can be produced thereby. Another known powder metallurgical process, which is particularly suitable for the production of sintered moldings having a complex geometry, is powder injection molding. For this purpose, a sinterable powder is mixed with a thermoplastic, which in powder injection molding technology is usually also referred to as a binder (but must not be confused with the metallic phase referred to in the technology of hard sintered moldings as the binder of the hard material), and, if required, further assistants, so that overall a thermoplastic injection molding material (feedstock) is formed. This is injection molded in a mold by the injection molding technology known from the processing of thermoplastics, the thermoplastic powder injection molding binder is then removed from the injection molded body (green compact), and the body (brown compact) freed from this binder is sintered to give the finished sintered molding. The main problem in this process is the binder removal, which is usually carried out thermally by pyrolysis of the thermoplastic, cracks frequently forming in the workpiece. A thermoplastic which is catalytically removable at low temperatures is therefore advantageously used. EP-A 413 231 describes such a catalytic binder removal process, EP-A 465 940 and EP-A 446 708 disclose feedstocks for the production of metallic moldings, and EP-A 444 475 discloses a feedstock for the production of ceramic moldings. Furthermore, EP-A 443 048 discloses the production of hard sintered moldings by a powder metallurgical method, and EP-A 800 882 describes an improved process for the preparation of feedstocks for hard sintered moldings.

U.S. Pat. No. 5,714,115 discloses a special nickel-free austenitic steel alloy comprising not more than 0.3% by weight of carbon, from 2 to 26% by weight of manganese, from 11 to 24% by weight of chromium, from 2.5 to 10% by weight of molybdenum and not more than 8% by weight of tungsten, whose austenitic structure is stabilized by from 0.55 to 1.2% by weight of nitrogen. This alloy is used for workpieces which are in contact, or can come into contact, with the human body, in order to avoid the allergic reactions to nickel or cobalt, which have recently increasingly given rise to concerns. W.-F. Bahre, P. J. Uggowitzer and M. O. Speidel: "Competitive Advantages by Near-Net-Shape-Manufacturing" (Editor H.-D. Kunze), Deutsche Gesellschaft für Metallurgie, Frankfurt, 1997 (ISBN 3-88355-246-1) and H. Wohlfromm, M. Blömacher, D. Weinand, E.-M. Langer and M. Schwarz: "Novel Materials in Metal Injection Molding", Proceedings of PIM-97 - 1st European Symposium on Powder Injection Moulding, Munich Trade Fair Centre, Munich, Germany, Oct. 15–16, 1997, European Powder Metallurgy Association 1997, (ISBN 1-899072-05-5), describe powder injection molding processes for the production of nickel-free nitrogen-containing steels with nitriding during the sintering process.

In spite of the well developed prior art, it is an object of the present invention to provide novel hard sintered moldings having improved or novel properties and broader or novel fields of use, in view of the importance of the class of materials.

We have found that this object is achieved by hard sintered moldings having a nickel- and cobalt-free, nitrogen-containing steel as a binder of the hard phase. We have also found a process and feedstocks for the production of the novel hard sintered moldings.

The novel sintered moldings have excellent mechanical, thermal and magnetic properties. They are hard, have a high melting point, are highly resistant to thermal shocks, are non-magnetic in preferred embodiments and also cause no nickel or cobalt allergies. Moreover, they exhibit no giant grain growth during the sintering and can be very readily polished. They can be produced by the novel process in a simple manner; in particular, in the production of the novel hard sintered moldings, only a comparatively low sintering temperature is required compared with the use of nickel or cobalt binders.

The novel hard sintered moldings contain at least 50, preferably at least 70, particularly preferably at least 80, % by weight of hard material. They furthermore contain not more than 99, preferably not more than 97, particularly preferably not more than 95, % by weight of hard material. Accordingly, the novel hard sintered moldings contain at least 1, preferably at least 3, particularly preferably at least 5 and not more than 50, preferably not more than 30, particularly preferably not more than 20, % by weight of metallic binder.

The metallic binder of the novel hard sintered moldings, its precursor or its components and the hard material are used in the form of fine powders. The mean particle sizes used are usually less than 100, preferably less than 50, particularly preferably less than 20, micrometers and in general approx. 0.1 micrometer. Such powders are commercially available or can be prepared in any known manner, for example by precipitation and calcination, or milling, and the metallic powders can be prepared in particular by water or gas atomization.

Novel hard sintered moldings contain a hard material. All known ceramic substances or hard metals used to date as hard materials in known hard sintered moldings may be used, individually or in the form of a mixture, as hard material, for example the oxides, such as alumina, cadmium oxide, chromium oxide, magnesium oxide, silica, thorium oxide, uranium oxide and/or zirconium oxide, the carbides, such as boron carbide, zirconium carbide, chromium carbide, silicon carbide, tantalum carbide, titanium carbide, niobium carbide and/or tungsten carbide, the borides, such as chromium boride, titanium boride and/or zirconium boride, the silicides, such as molybdenum silicide, and/or the nitrides, such as silicon nitride, titanium nitride and/or zirconium nitride, and/or mixed phases, such as carbonitrides, oxycarbides and/or sialons. The use of tantalum carbide, tungsten carbide, niobium carbide, titanium nitride and/or zirconium nitride is preferred and the use of tantalum carbide and/or tungsten carbide is particularly preferred. These hard materials are known and are conventional commercial products.

The metallic binder of the novel hard sintered moldings is a nickel- and cobalt-free, nitrogen-containing steel. Freedom from nickel and/or cobalt is to be understood as meaning the absence of intentionally added amounts of these elements. The permissible upper limit for nickel and/or cobalt in the metallic binder of the novel hard sintered moldings is in general 0.5, preferably 0.3, particularly preferably 0.05, % by weight. These contents are normally below the usual limits for the release of nickel ions and/or cobalt ions during the use of the workpiece on or in the human body (as a watch, earpiece, implant, etc.). Very particularly preferably, the metallic binder contains nickel and/or cobalt exclusively as unavoidable impurities. The steel used as metallic binder contains nitrogen, preferably in an amount of at least 0.3% by weight and not more than 2% by weight.

The metallic binder is preferably a nonferromagnetic and in particular an austenitic steel. Austenitic steels are known to be those in which a face centered cubic lattice of the iron atoms is present. In the iron/carbon system, the austenite structure is a high-temperature modification which is stabilized by specific added alloys at low temperatures. Further added alloys impart toughness, corrosion resistance, hardness or other respective desired properties to the austenitic steels, depending on the requirements. The production, processing and properties of austenitic steels are well known to a person skilled in the art in the area of engineering materials.

In a particularly preferred form, the metallic binder is an austenitic iron alloy which contains not more than 0.5% by weight of carbon, from 2 to 26% by weight of manganese, from 11 to 24% by weight of chromium, from 2.5 to 10% by weight of molybdenum, not more than 8% by weight of tungsten and from 0.55 to 1.2% by weight of nitrogen. Preferably, in addition to said elements, it contains no further impurities apart from unavoidable ones. Examples of impurities which can usually be tolerated in the novel hard sintered moldings are up to 0.5% by weight of nickel and/or cobalt, up to 2% by weight of silicon, up to 0.2% by weight of sulfur, up to 5% by weight of bismuth and up to 5% by weight of copper.

The very particularly preferred metallic binder of the novel hard sintered moldings is austenitic and contains not more than 0.3, preferably not more than 0.1, % by weight of carbon. It contains at least 2, preferably at least 6, % by weight and not more than 26, preferably not more than 20, % by weight of manganese. It contains at least 11% by weight and not more than 24, preferably not more than 20, % by weight of chromium. It furthermore contains at least 2.5% by weight and not more than 10, preferably not more than 6, % by weight of molybdenum. If particularly high corrosion stability is required, the metallic binder of the novel hard sintered moldings contains tungsten in an amount of not more than 8, preferably not more than 6, % by weight. It furthermore contains at least 0.55, preferably at least 0.7, % by weight and not more than 1.2, preferably not more than 1.1, % by weight of nitrogen. This metallic binder also contains iron over and above said elements, and the total remainder to 100% by weight, with the exception of impurities, is preferably iron.

Such alloys are known to a person skilled in the art, commercially available or preparable in a simple manner by known metallurgical processes. Since the nitrogen content of these alloys above from 0.8 to 0.9% by weight is higher than the nitrogen solubility in the molten alloy, the alloy must be melted under superatmospheric nitrogen pressure, which is possible, for example, by the electroslag remelting process under pressure. It is just as possible to introduce the nitrogen content into the metallic binder of the otherwise finished sintered molding in a nitriding step by heat treatment in a nitrogen-containing furnace atmosphere. However, the nitrogen content is preferably established by nitriding during the sintering or immediately before or after it, without intermediate removal of the sintered molding from the sinter furnace or cooling below the sinter temperature or the nitriding temperature. Such sinter and nitriding processes are known to a person skilled in the art.

In the case of subsequent nitriding, the corresponding nitrogen-free alloy or an alloy having relatively low nitrogen content should be used as precursor of the actual metallic binder, said alloy then being converted into the metallic binder of the novel hard sintered molding in the course of the nitriding process. These alloys, too, are commercially available or can be obtained by smelting in a known manner. In the case of the preferred austenitic binders, the corresponding nitrogen-free precursor is a ferritic steel which is converted into an austenitic steel by the nitriding.

It is also possible to prepare the metallic binder or its nitrogen-free precursor by the master alloy technique known to a person skilled in the art, from a master alloy or a plurality of master alloys, which essentially contains or contain the elements other than iron and, if required, also iron, and pure iron, so that the novel metallic binder does not form until during the sinter and/or nitriding process as a result of diffusion of the alloy elements, possibly including the nitrogen.

The novel hard sintered moldings are produced by a powder metallurgical method. For this purpose, the hard material and the binder or its precursor are mixed in powder form and, by means of a shaping tool, converted into a shape which is as close as possible to its final desired geometric shape, in order to avoid any expensive reworking of the finished hard sintered molding. The shaping step is carried out by means of a conventional shaping tool, for example a press. During sintering, shrinkage of the workpieces is known to occur and is usually compensated by correspondingly larger dimensioning of the moldings prior to sintering. Thereafter, the molding is sintered in a sinter furnace to give the hard sintered molding and, if a nitrogen-free precursor of the metallic binder or one having a relatively low nitrogen content was used, the desired nitrogen content is established by nitriding.

That composition of the furnace atmosphere which is optimum for the sintering and, if required, for the nitriding and the operating temperature program depend on the exact chemical composition of the metallic binder used or its precursor, in particular its nitrogen-dissolving capacity, on the desired nitrogen content of the metallic binder and on the particle size of the powders used. In general, both the increase in the nitrogen partial pressure in the furnace atmosphere and the reduction in the temperature are directly correlated with higher nitrogen contents in the metallic binder. However, since a reduction in the temperature not only causes the sinter process itself to slow down but also decreases the rate of diffusion of the nitrogen in the metallic binder of the hard sintered molding, the sinter and/or nitriding process takes corresponding longer at lower temperature. The combination of furnace atmosphere, in particular the nitrogen partial pressure, temperature and duration of sintering and/or nitriding which is optimum for achieving a specific desired nitrogen content in a homogeneous, dense sintered molding can be readily determined from case to case on the basis of a few routine experiments. Such sinter processes have been described for sintered moldings comprising the steel used in a particularly preferred form as metallic binder, without a hard phase, for example in the publications by Bahre et al. and Wohlfromm et al. These two publications are hereby incorporated by reference. The properties of the steel do not change as a result of the presence of the hard phase, so that the measures described there have the same effects in the novel process.

Usually, nitrogen partial pressures in the furnace atmosphere of at least 0.1, preferably at least 0.25, bar are used. This nitrogen partial pressure is in general not more than 2, preferably not more than 1, bar. The furnace atmosphere may consist of pure nitrogen or may also contain inert gases, such as argon, and/or reactive gases, such as hydrogen. In general, it is advantageous to use a mixture of nitrogen and hydrogen as furnace atmosphere in order to remove possibly troublesome oxidic impurities from the metals. The hydrogen content, if present, is in general at least 5, preferably at least 15, % by volume and in general not more than 50, preferably not more than 30, % by volume. If desired, this furnace atmosphere may additionally contain inert gases, for example argon. The furnace atmosphere should preferably be substantially dry, and in general a dew point of −40° C. is sufficient for this purpose.

The (absolute) pressure in the sinter and/or nitriding furnace is usually at least 100, preferably at least 250, mbar. In general, it is furthermore not more than 2.5, preferably not more than 2, bar. Particularly preferably, atmospheric pressure is employed.

The sintering and/or nitriding temperature is in general at least 1000° C., preferably at least 1050° C., particularly preferably at least 1100° C. It is furthermore generally not more than 1450° C., preferably not more than 1400° C., particularly preferably not more than 1350° C. The temperature can be varied during the sinter and/or nitriding process, for example in order to completely or substantially dense-sinter the workpiece only at a higher temperature and then to establish the desired nitrogen content at a lower temperature.

The optimum heat-up rates are readily determined by a few routine experiments and are usually at least 1, preferably at least 2, particularly preferably at least 3, ° C. per minute. For economic reasons, a very high heat-up rate is generally desirable in order to avoid an adverse effect on the quality of the sintering and/or nitriding, but it will generally be necessary to establish a heat-up rate below 20° C. per minute. During heating up to the sintering and/or nitriding temperature, it is advantageous in certain circumstances to maintain a waiting time at a temperature which is below the sintering and/or nitriding temperature, for example to maintain a temperature of from 500 to 700° C., for example 600° C., over a period of from 30 minutes to 2 hours, for example 1 hour.

The duration of sintering and/or nitriding, i.e. the holding time at sintering and/or nitriding temperature, is generally established so that the sintered moldings are both sufficiently densely sintered and sufficiently homogeneously nitrided. At customary sintering and/or nitriding temperatures, nitrogen partial pressures and molding sizes, the duration of sintering and/or nitriding is in general at least 30, preferably at least 60, minutes. This duration of the sinter and/or nitriding process plays a role in determining the production rate, and the sintering and/or nitriding are therefore preferably carried out so that the sinter and/or nitriding process does not last for an unsatisfactorily long time from the economic point of view. In general, the sinter and nitriding process (without the heat-up and cooling phases) can be terminated after not more than 10 hours.

The sinter and/or nitriding process is terminated by cooling the sintered moldings. Depending on the composition of the binder, a specific cooling method may be required, for example very rapid cooling, in order to obtain high-temperature phases or to prevent the separation of the components of the steel. In general, it is also desirable for economic reasons to cool as rapidly as possible in order to achieve a high production rate. The upper limit of the cooling rate is reached when sintered moldings having defects caused by excessively rapid cooling, such as splitting, cracking or deformation, occur to an extent which is unsatisfactorily high in economic terms. The optimum cooling rate is accordingly readily determined in a few routine experiments. In general, and in particular in the case of the preferred compositions of the metallic binder, it is advisable to use cooling rates of at least 100, preferably at least 200, ° C. per minute. The sintered molding can, for example, be quenched in cold water or oil.

Following the sintering and/or nitriding, any desired aftertreatment, for example solution heat treatment and quenching in water or oil or hot isostatic pressing of the sintered moldings, can be carried out. The sintered moldings are preferably subjected to the solution heat treatment by subjecting them to a heat treatment for at least 5, preferably at least 10, minutes and not more than 2 hours, preferably not more than 1 hour, at a temperature of at least 1000° C., preferably at least 1100° C., and not more than 1250° C., preferably not more than 1200° C., under inert gas, for example under nitrogen and/or argon, and then quenching them, for example in cold water.

Preferably, and in particular for the production of workpieces having a complicated geometric shape, the novel hard sintered moldings are produced by the powder injection molding process. This differs in the procedure from conventional powder metallurgical processes, such as pressing and sintering, in the manner of the shaping and a resulting additional step for removing the thermoplastic powder injection molding binder used for the shaping. However, the statements made above are applicable to sintering and nitriding.

To carry out this process, the hard material powder and metal powder are mixed with a thermoplastic, nonmetallic material as a powder injection molding binder and the powder injection molding material is thus prepared. Suitable thermoplastics for the preparation of injection molding materials are known. In general, thermoplastics are used, for example, polyolefins, such as polyethylene or polypropylene, or polyethers, such as polyethylene oxide (polyethylene glycol). The use of those thermoplastics which can be removed from the green compact catalytically at comparatively low temperature is preferred. A polyacetal plastic is preferably used as the base of the thermoplastic, and polyoxymethylene (POM, paraformaldehyde, paraldehyde) is particularly preferably used. Assistants for improving the processing properties of the injection molding material, for example dispersants, are, if desired, also mixed with said injection molding material. Comparable thermoplastic materials and processes for their preparation and processing by injection molding and catalytic binder removal are known and are described, for example, in EP-A 413 231, EP-A 465 940, EP-A 446 708, EP-A 444 475 and EP-A 800 882, which are hereby incorporated by reference. The metallic or ceramic powder stated there in each case should be replaced accordingly by a powder mixture comprising the hard material and the metallic binder or its precursor.

A preferred novel injection molding material consists of:

a) from 40 to 65% by volume of a mixture of
   - a1) from 50 to 99% by weight of a hard material in powder form having a mean particle size of at least 0.1 micrometer and not more than 100 micrometers and
   - a2) from 1 to 50% by weight of a nickel- and cobalt-free, nitrogen-containing steel or of a precursor of such a steel in powder form having a mean particle size of at least 0.1 micrometer and not more than 100 micrometers;

b) from 35 to 60% by volume of a mixture of
   - b1) from 70 to 90% by weight of a polyoxymethylene homo- or copolymer comprising up to 10 mol% of comonomer units and
   - b2) from 10 to 30% by weight of a polyoxymethylene copolymer having a comonomer content of from 20 to 99 mol% of poly-1,3-dioxolane, poly-1,3-dioxane or poly-1,3-dioxepan, or of a polymer homogeneously dissolved in b1) or dispersed with a mean particle size of less than 1 micrometer in b1), or mixtures thereof, as a thermoplastic powder injection molding binder of the powder mixture a) and c) from 0 to 5% by volume of a dispersant.

The known ceramic substances or hard metals used in known hard sintered moldings are used, individually or in the form of a mixture, as hard material a1), for example oxides, such as alumina, cadmium oxide, chromium oxide, magnesium oxide, silica, thorium oxide, uranium oxide and/or zirconium oxide, carbides, such as boron carbide, zirconium carbide, chromium carbide, silicon carbide, tantalum carbide, titanium carbide, niobium carbide and/or tunsten carbide, borides, such as chromium boride, titanium boride and/or zirconium boride, silicides, such as molybdenum silicide, and/or nitrides, such as silicon nitride, titanium nitride and/or zirconium nitride, and/or mixed phases, such as carbonitrides, oxycarbides and/or sialons. The hard material is preferably tantalum carbide, tungsten carbide, niobium carbide, titanium nitride and/or zirconium nitride, particularly preferably tantalum carbide and/or tungsten carbide.

An iron alloy which contains not more than 0.5% by weight of carbon, from 2 to 26% by weight of manganese, from 11 to 24% by weight of chromium, from 2.5 to 10% by weight of molybdenum and not more than 8% by weight of tungsten is preferably used as the nickel- and cobalt-free, nitrogen-containing steel or precursor of such a steel a2).

An iron alloy which contains not more than 0.3, advantageously not more than 0.1, % by weight of carbon, at least 2, preferably at least 6, % by weight and not more than 26, advantageously not more than 20, % by weight of manganese, at least 11% by weight and not more than 24, advantageously not more than 20, % by weight of chromium and furthermore at least 2.5% by weight and not more than 10, advantageously not more than 6, % by weight of molybdenum is particularly preferably used as component a2). If particularly high corrosion stability of the hard sintered moldings finally to be produced from the injection molding material is required, component a2) additionally contains tungsten in an amount of not more than 8, preferably not more than 6, % by weight.

The component a2) also contains iron over and above the stated elements. A certain content of impurities in a2) over and above 10 the level of unavoidable impurities is generally tolerable depending on the use of the hard sintered moldings. Examples of impurities which can usually be tolerated are up to 0.5% by weight of nickel and/or cobalt, up to 2% by weight of silicon, up to 0.2% by weight of sulfur, up to 5% by weight of bismuth and up to 5% by weight of copper. However, the total remainder of component a2) to 100% by weight is preferably iron, apart from unavoidable impurities.

However, it is not necessary to use homogeneous alloys as component a2); rather, the alloy elements may also be present as a mixture of different alloys and/or pure elements, from which an alloy having the desired gross composition forms by diffusion in the sinter process according to the master alloy technique. For example, component a2) may be a mixture of pure iron powder and an alloy powder which contains the other alloy elements and, if desired, also iron.

The hard material (component a1)) is preferably present in a) in an amount of at least 70, particularly preferably at least 80, % by weight. Its amount is furthermore preferably not more than 97, particularly preferably not more than 95, % by weight. The metallic binder or its precursor (component a2)) is accordingly present in a) preferably in an amount of at least 3, particularly preferably at least 5, % by weight and preferably not more than 30, particularly preferably not more than 20, % by weight. The mean particle sizes of hard material a1) and metallic powder a2) are preferably not more than 50, particularly preferably not more than 20, micrometers.

The polyoxymethylenehomo- and copolymers used as components b1) and b2) and the polymers optionally used as component b2) and homogeneously dissolved or dispersed in component b1) are known and are described, for example as component B1) and B2), respectively, in EP-A 444 475. The homopolymers are usually prepared by polymerization (generally catalyzed polymerization) of formaldehyde or trioxane. For the preparation of polyoxymethylene copolymers, a cyclic ether or a plurality of cyclic ethers is or are conveniently used as comonomer(s) together with formaldehyde and/or trioxane in the polymerization, so that the polyoxymethylene chain with its sequence of (—$OCH_2$) units is interrupted by units in which more than one carbon atom is arranged between two oxygen atoms. Examples of cyclic ethers suitable as comonomers are ethylene oxide, 1,2-propylene oxide, 1,2-butylene oxide, 1,3-dioxane, 1,3-dioxolane, dioxepan, linear oligo- and polyformals, such as polydioxolane or polydioxepan, and oxymethylene terpolymers. A polymer may also be used as component b2), for example an aliphatic polyurethane, aliphatic uncrosslinked polyepoxides, poly($C_2$-$C_5$)alkylene oxides, aliphatic polyamides, polyacrylates, polyolefins and mixtures thereof.

The components b1) and b2) may be identical except for a different content of comonomer(s).

Component c) is a dispersant. Dispersants are widely used and are known to a person skilled in the art. In general, it is possible to use any dispersant which leads to an improvement in the homogeneity of the injection molding material. Preferred dispersants are oligomeric polyethylene oxide having an average molecular weight of from 200 to 400, stearic acid, hydroxystearic acid, fatty alcohols, fatty alcohol sulfonates and block copolymers of ethylene oxide and propylene oxide. A mixture of different substances having dispersing properties may also be used as the dispersant.

The molding of the novel injection molding materials is effected in a conventional manner using customary injection molding machines. The moldings are freed from the thermoplastic powder injection molding binder in a conventional manner, for example by pyrolysis. The powder injection molding binder is removed from the preferred novel injection molding material preferably catalytically by subjecting the green compacts in a known manner to a heat treatment with an atmosphere containing a gaseous acid. This atmosphere is produced by vaporizing an acid with sufficient vapor pressure, conveniently by passing a carrier gas, in particular nitrogen, through a storage vessel containing an acid, advantageously nitric acid, and then passing the acid-containing gas into the oven for binder removal. The optimum acid concentration in the oven for binder removal is dependent on the specific material and on the dimensions of the workpiece and is determined from case to case by routine experiments. In general, the treatment in such an atmosphere at from 20 to 180° C. over a period of from 10 minutes to 24 hours is sufficient for binder removal. After the binder removal, any residues of the thermoplastic powder injection molding binder and/or of the assistants still present are pyrolysed by heating up to sintering temperature and thus completely removed.

The injection moldings freed from binder, as in the case of moldings originating from other shaping processes, for example pressing, are then sintered and then, if required, nitrided.

EXAMPLES

Example 1

3600 g of tantalum carbide powder (mean particle diameter 0.9 micrometer), 400 g of a ferritic alloy powder comprising 17% by weight of chromium, 3.4% by weight of molybdenum, and 12.1% by weight of manganese, the remainder being iron and unavoidable impurities, in particular 0.035% by weight of nickel and 0.6% by weight of silicon, also being present (mean particle size 8 micrometers), 64 g of polyethylene glycol having an average molecular weight of 800 g/mol, 43 g of polybutanediol formal having an average molecular weight of about 30,000 glmol and 312 g of polyoxymethylene containing 2% by weight of butanediol formal were initially taken in a heatable kneader, melted by heating to 175° C. and homogenized for one hour by kneading. Thereafter, the mixture was cooled and granulated. The granules were injection molded to give moldings which were then freed from binder catalytically at 120° C. in a nitrogen atmosphere containing nitric acid. Thereafter, the moldings were sintered in a sinter furnace for one hour at 1350° C. and then for 5 hours at 1280° C. in a furnace atmosphere comprising 75% by volume of nitrogen and 25% by volume of hydrogen. The sintered moldings were then still very weakly magnetic and were rendered completely nonmagnetic by a subsequent heat treatment for 10 minutes at 1150° C. under nitrogen followed by quenching in water. The density of the pale gold sintered moldings was 13.2 g/ml (theoretical density 13.3 g/ml).

The sintered moldings had a Vickers hardness 0.5 of 1400 mm, a four-point flexible strength according to DIN EN 843 (in the as fired state) of 774 MPa and a cracking resistance $K_{Ic}$ according to DIN 51109 of 12 MPa(m)$^{0.5}$. The parts were ground and polished. The microstructure was homogeneous and showed no crystals having a diameter above 5 micrometers.

Comparative Example 1

3600 g of tantalum carbide powder (mean particle diameter 0.9 micrometer), 400 g of nickel powder (mean particle size less than 10 micrometers), 56 g of polyethylene glycol having an average molecular weight of about 800 g/mol, 41 g of polybutanediol formal having an average molecular weight of about 30,000 g/mol and 303 g of polyoxymethylene containing 2% by weight of butanediol formal were initially taken in a heatable kneader, melted by heating to 175° C. and homogenized for one hour by kneading. The mixture was then cooled and granulated. The granules were injection molded to give moldings from which the binder was then removed catalytically at 120° C. in a nitrogen atmosphere containing nitric acid. The moldings were then sintered in a sinter furnace for one hour at 1500° C. under nitrogen. The density of the sintered moldings was 13.6 g/ml (the same as the theoretical density). In parallel experiments, lower sintering temperatures were used, but these did not lead to a satisfactory sinter density.

The sintered moldings had a Vickers hardness 0.5 of 950, but further mechanical properties were not determined. The parts were ground and polished. The microstructure was virtually pore-free, but giant grain growth was observed; crystallite sizes up to more than 100 micrometers in diameter had formed, which were visible to the naked eye and substantially impaired the visual appearance of the polished parts.

A comparison of Example 1 with Comparative example 1 shows that the novel sintered moldings not only have excellent mechanical properties but also have advantages in applications where the visual impression of the sintered molding is decisive.

We claim:

1. A hard sintered molding having a nickel- and cobalt-free, nitrogen-containing steel as a binder and a hard material as the hard phase, the binder being an austenitic iron alloy which contains not more than 0.5% by weight of carbon, from 2 to 26% by weight of manganese, from 11 to 24% by weight of chromium, from 2.5 to 10% by weight of molybdenum, not more than 8% by weight of tungsten and from 0.55 to 1.2% by weight of nitrogen.

2. A hard sintered molding as claimed in claim 1, the hard material being tantalum carbide, tungsten carbide, niobium carbide, titanium nitride and/or zirconium nitride.

3. A hard sintered molding as claimed in claim 2, the hard material being tantalum carbide and/or tungsten carbide.

4. A process of producing the sintered molding defined in claim 1, which comprises providing a thermoplastic injection molding material which comprises a thermoplastic binder material, the austenitic iron alloy or a nitrogen-free precursor of the iron alloy in powder form, and a hard material in powder form, the thermoplastic injection molding material in a powder injection molding process to give a molded article, and removing the thermoplastic binder material to give a molding, and sintering the molding, and, if the thermoplastic injection molding material contained the nitrogen-free precursor of the iron alloy, which further comprises nitriding the iron alloy before, during or after sintering the molding.

5. A thermoplastic injection molding material which contains an austenitic iron alloy, which contains not more than 0.5% by weight of carbon, from 2 to 26% by weight of manganese, from 11 to 24% by weight of chromium, from 2.5 to 10% by weight of molybdenum, not more than 8% by weight of tungsten and from 0.55 to 1.2% by weight of nitrogen, or a nitrogen-free precursor of this iron alloy in powder form, a hard material in powder form, and a thermoplastic.

* * * * *

UNITED STATES PATENT AND TRADEMARK OFFICE

CERTIFICATE OF CORRECTION

PATENT NO. : 6,641,640 B1
DATED : November 4, 2003
INVENTOR(S) : Hesse et al.

It is certified that error appears in the above-identified patent and that said Letters Patent is hereby corrected as shown below:

Column 12,
Line 7, insert -- forming -- before “the thermoplastic”.

Signed and Sealed this

Twenty-fourth Day of February, 2004

JON W. DUDAS
*Acting Director of the United States Patent and Trademark Office*